US008141737B1

(12) United States Patent
Tsai

(10) Patent No.: US 8,141,737 B1
(45) Date of Patent: Mar. 27, 2012

(54) MESH CONTAINER

(75) Inventor: Cheng-Yuan Tsai, Taichung Hsien (TW)

(73) Assignee: Liang Harng Industry Co., Ltd., Taichung Hsien (TW)

( * ) Notice: Subject to any disclaimer, the term of this patent is extended or adjusted under 35 U.S.C. 154(b) by 32 days.

(21) Appl. No.: 12/917,063

(22) Filed: Nov. 1, 2010

(51) Int. Cl.
*B65D 6/08* (2006.01)

(52) U.S. Cl. ..... 220/485; 220/493; 220/642

(58) Field of Classification Search ..... 220/485, 220/491, 493, 494, 640–642
See application file for complete search history.

(56) References Cited

U.S. PATENT DOCUMENTS 6,718,635 B2 * 4/2004 Cheng et al. ..... 29/896.6
7,228,985 B2 * 6/2007 Yeh ..... 220/485
7,270,245 B2 * 9/2007 Cheng et al. ..... 220/62.1
7,428,976 B2 * 9/2008 Cheng et al. ..... 220/642
8,006,858 B2 * 8/2011 Cheng et al. ..... 220/485

FOREIGN PATENT DOCUMENTS

TW 560512 11/2003

* cited by examiner

*Primary Examiner* — Harry Grosso
(74) *Attorney, Agent, or Firm* — Muncy, Geissler, Olds & Lowe, PLLC

(57) ABSTRACT

A mesh container includes a bottom meshwork, a side meshwork and a frame. The side meshwork is arranged around a periphery edge of the bottom meshwork. The side meshwork has a bottom edge which is connected with the periphery edge. The side meshwork has a top edge which stretches outwardly along a direction parallel to the bottom meshwork. The frame is arranged around the side meshwork. The frame clamps the top edge of the side meshwork. The frame has two reverse edgings and a crease so as to increase strength of the frame. As such, the container has a stable frame.

3 Claims, 3 Drawing Sheets

MESH CONTAINER

BACKGROUND OF THE INVENTION

1. Field of the Invention

The present invention relates to a basket or a mesh container.

2. Description of the Prior Art

Some conventional containers are made of meshwork which is cut and fabricated properly.

For example, the mesh container disclosed in U.S. Pat. No. 7,270,245 includes three pieces of mesh. One of the pieces is bent to form a bottom wall and two sidewalls. The other pieces are joined together with the sidewalls. A rail is then disposed on these pieces of mesh so as to complete the container. Similarly, some containers are also disclosed in U.S. Pat. No. 6,718,635 and TW 560512.

However, rails of the containers usually have edges exposed outwardly. The edges are sharpened in manufacturing, so that users will probably be injured by the edges. Besides, coatings or paintings covered on the rails may flake off from the edges.

Moreover, horizontal top edges of the mesh pieces are totally covered by the rails. As a result, cost of the rails is increased in a reason that a large amount of material should be prepared for the rails. In addition, contact surface between the rails and a framework is considerably large. Friction between the container and the framework is also considerably large.

The present invention is, therefore, arisen to obviate or at least mitigate the above mentioned disadvantages.

SUMMARY OF THE INVENTION

The main object of the present invention is to provide a mesh container which has a stable rail, and the cost of the container is low.

To achieve the above and other objects, a mesh container of the present invention includes a bottom meshwork, a side meshwork and a frame.

The bottom meshwork has a periphery edge. The side meshwork has a first end, a second end, a bottom edge and a top edge. The first end and the second end are connected with each other. The side meshwork is arranged around the periphery edge. The bottom edge is connected with the periphery edge. The top edge stretches outwardly along a direction parallel to the bottom meshwork.

The frame is arranged around the side meshwork. The frame includes a top clipping portion and a bottom clipping portion connected with the top clipping portion. The top edge is positioned between the top clipping portion and the bottom clipping portion. At least one of the top clipping portion and the bottom clipping portion is formed with a v-shaped crease. The crease protrudes toward the top edge, so that the top edge is clipped by the top clipping portion and the bottom clipping portion.

Each one of the top clipping portion and the bottom clipping portion has a distal end bent inwardly toward the top edge. Each one of the top clipping portion and the bottom clipping portion has a distal direction aimed to a distal end of the top edge.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
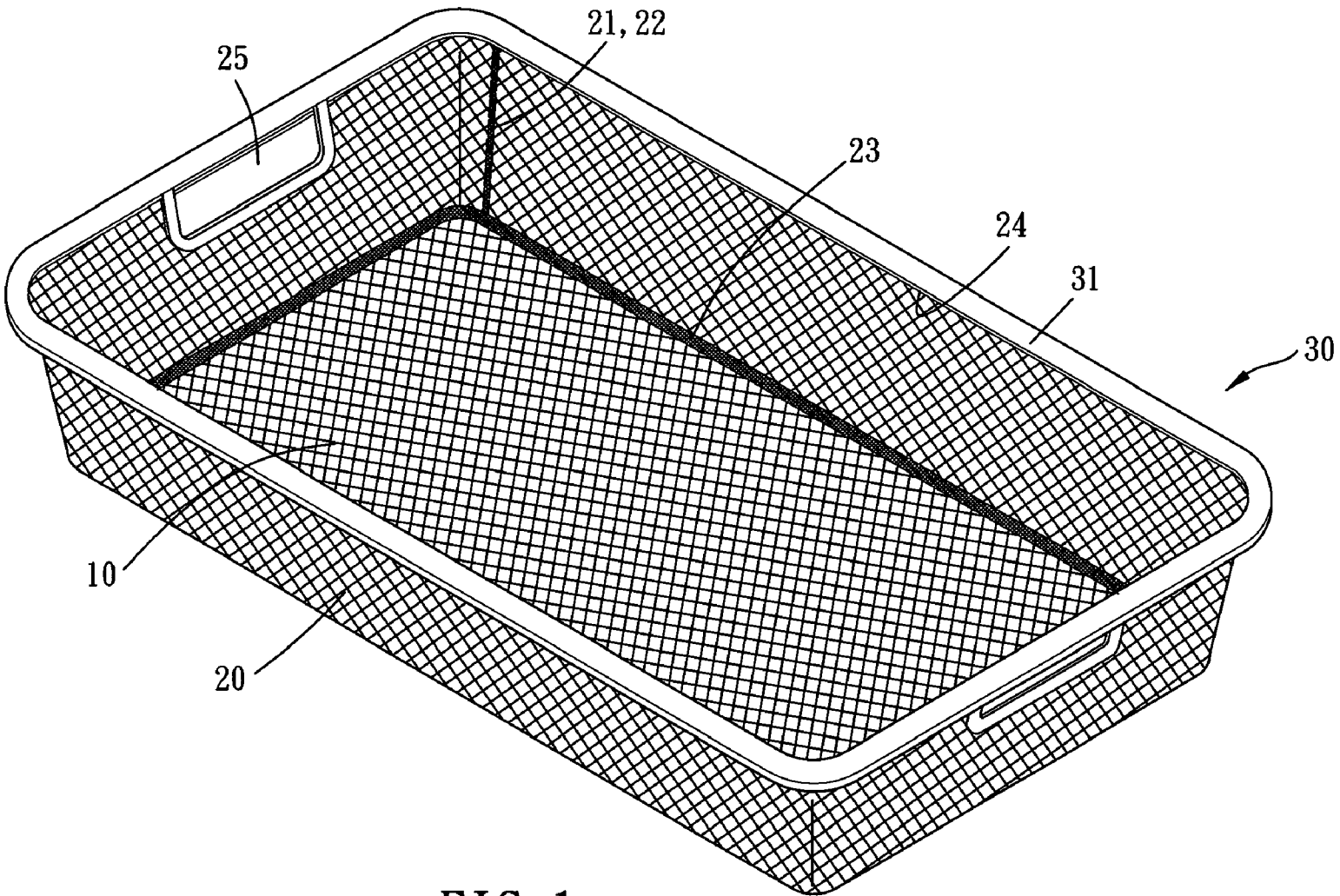
FIG. 1 is a stereogram showing a preferred embodiment of the present invention.
Figure 2:
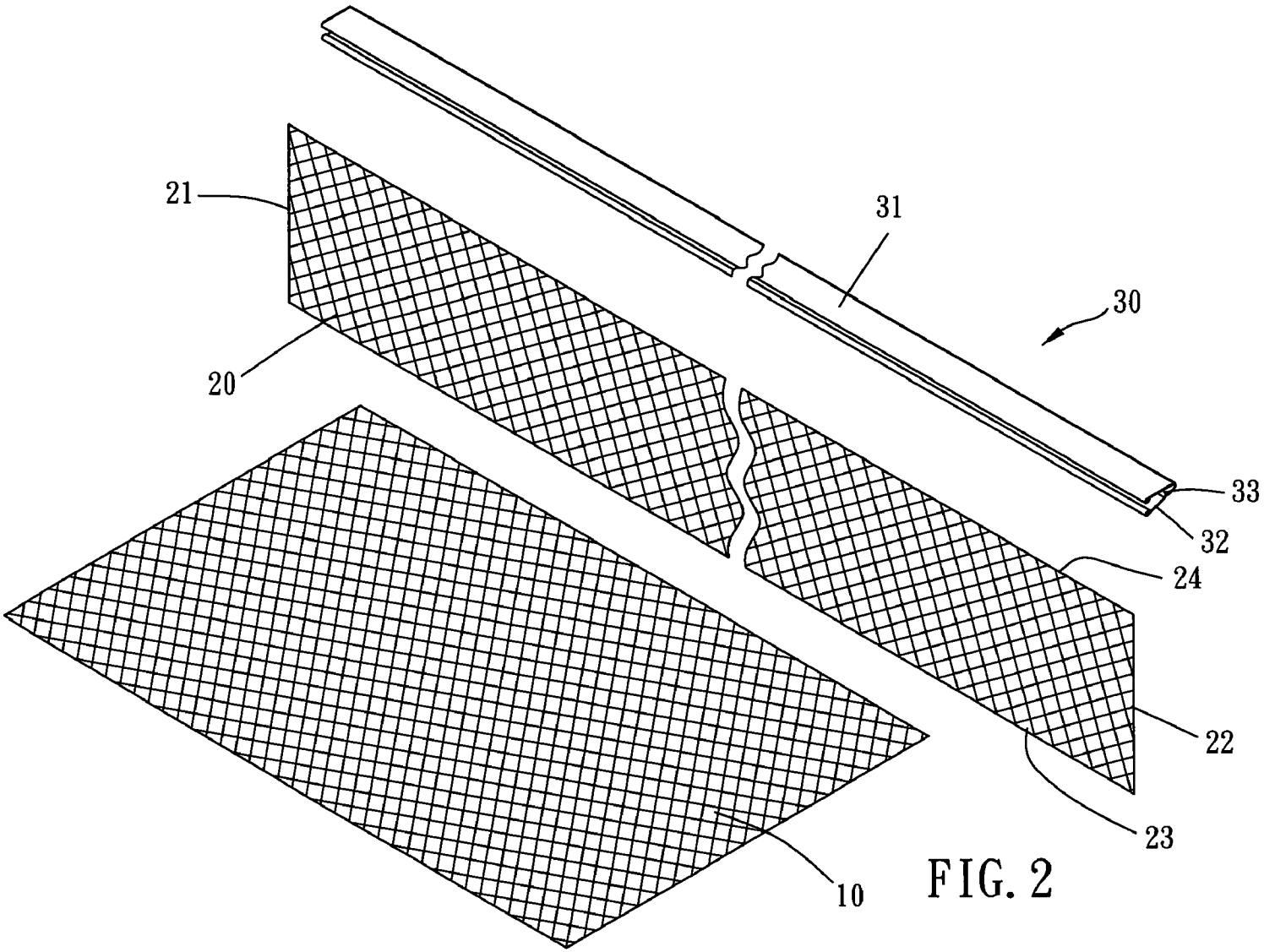
FIG. 2 is a breakdown drawing showing a preferred embodiment of the present invention.
Figure 3:
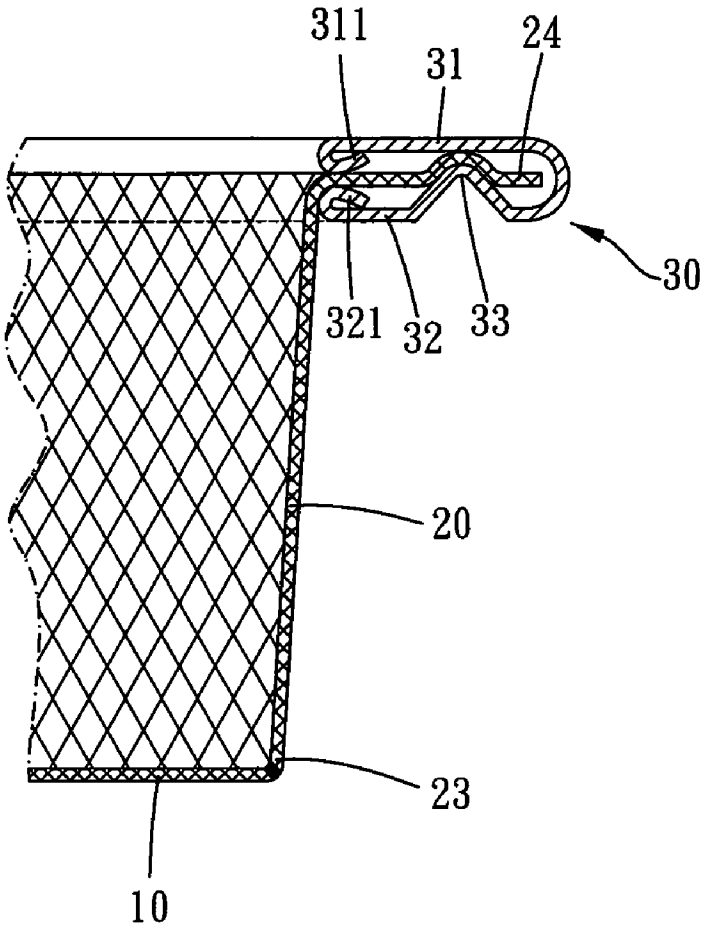
FIG. 3 is a partial profile showing a preferred embodiment of the present invention.

Please refer to FIG. 1 to FIG. 3 for a preferred embodiment of the present invention. The mesh container of the present embodiment includes a bottom meshwork 10, a side meshwork 20 and a frame 30.

The bottom meshwork 10 has a periphery edge. The side meshwork 20 has a first end 21, a second end 22, a bottom edge 23 and a top edge 24. The first end 21 and the second end 22 are connected with each other. The side meshwork 20 is arranged around the periphery edge. The bottom edge 23 is connected with the periphery edge. Preferably, the bottom edge 23 is welded on to the periphery edge, and the first end 21 is welded on to the second end 22. The top edge 24 stretches outwardly along a direction parallel to the bottom meshwork 10. Preferably, the side meshwork 20 is formed with two hollowed portions 25 corresponded to each other, so that users may lift or grasp the container with the hollowed portions 25.

The frame 30 is arranged around the side meshwork 20. The frame includes a top clipping portion 31 and a bottom clipping portion 32. The bottom clipping portion 32 is connected with the top clipping portion 31. The top edge 24 is positioned between the top clipping portion 31 and the bottom clipping portion 32. At least one of the top clipping portion 31 and the bottom clipping portion 32 is formed with a v-shaped crease 33. The crease 33 protrudes toward the top edge 24, so that the top edge 24 is clipped by the top clipping portion 31 and the bottom clipping portion 32. Preferably, the top clipping portion 31 has a distal end 311 bent inwardly toward the top edge 24. The bottom clipping portion 32 has a distal end 321 bent inwardly toward the top edge 24. The top clipping portion 31 has a distal direction defined by the distal end 311 aimed to a distal end of the top edge 24. Similarly, the bottom clipping portion 32 has a distal direction defined by the distal end 321 aimed to the distal end of the top edge 24. As such, the top edge 24 may be further clamped by the distal ends 311 and 321.

Accordingly, the mesh container can be constructed from two meshworks. Processors are benefitted in meshwork cutting and material saving. Cost of manufacturing is cut down.

In addition, the frame has two reverse edgings located at two distal edges of the frame and a v-shaped crease located at one of the top clipping portion and the bottom clipping portion. As such, mechanical structure of the frame is strengthened. A thickness of the frame can be cut about 30% off when the frame still maintains considerably strength. In another aspect, cost of the frame is cut down. Furthermore, the frame is able to clamp the top edge by the edgings and the crease. The frame is firmly secured on the meshworks.

Moreover, the frame is formed with the crease so as to reduce the contact surface between the frame and a framework. As such, the friction between the mesh container and the framework is also reduced.

What is claimed is:

1. A mesh container, comprising:

a bottom meshwork, having a periphery edge;

a side meshwork, having a first end, a second end, a bottom edge and a top edge, the first end and the second end being connected with each other, the side meshwork being arranged around the periphery edge, the bottom edge being connected with the periphery edge, the top edge stretching outwardly along a direction parallel to the bottom meshwork;

a frame, arranged around the side meshwork, the frame comprising a top clipping portion and a bottom clipping portion connected with the top clipping portion, the top edge being positioned between the top clipping portion and the bottom clipping portion, at least one of the top clipping portion and the bottom clipping portion being formed with at least a v-shaped crease, the crease protruding toward the top edge, so that the top edge is clipped by the top clipping portion and the bottom clipping portion;

wherein each one of the top clipping portion and the bottom clipping portion has a distal end bent inwardly toward the top edge, each one of the top clipping portion and the bottom clipping portion has a distal direction aimed to a distal end of the top edge.

2. The mesh container of claim 1, wherein the bottom edge is welded on to the periphery edge, the first end is welded on to the second end.

3. The mesh container of claim 1, wherein the side meshwork is formed with two hollowed portions corresponded to each other, the mesh container is adapted for users to lift with the hollowed portions.

* * * * *